US009303539B1

(12) United States Patent
Peirce et al.

(10) Patent No.: US 9,303,539 B1
(45) Date of Patent: Apr. 5, 2016

(54) UNIVERSAL DRAIN PLUG SYSTEM AND METHOD

(71) Applicant: AGS I-Prop, LLC, Muskegon, MI (US)

(72) Inventors: John M. Peirce, Portage, MI (US); Ian K. Rosen, North Muskegon, MI (US)

(73) Assignee: AGS I-Prop, LLC, Muskegon, MI (US)

( * ) Notice: Subject to any disclaimer, the term of this patent is extended or adjusted under 35 U.S.C. 154(b) by 177 days.

(21) Appl. No.: 13/908,492

(22) Filed: Jun. 3, 2013

Related U.S. Application Data

(60) Provisional application No. 61/657,871, filed on Jun. 10, 2012.

(51) Int. Cl.
*F01M 11/04* (2006.01)

(52) U.S. Cl.
CPC ..... *F01M 11/0408* (2013.01)

(58) Field of Classification Search
CPC ..... F01M 11/0408; F01M 11/0458
USPC ..... 184/1.5
See application file for complete search history.

(56) References Cited

U.S. PATENT DOCUMENTS

| | | | | |
|---|---|---|---|---|
| 8,281,896 | B2 * | 10/2012 | Morgan | 184/1.5 |
| 2008/0019795 | A1 * | 1/2008 | Denton et al. | 411/383 |
| 2008/0099080 | A1 * | 5/2008 | Saini et al. | 137/454.5 |
| 2008/0128207 | A1 * | 6/2008 | Wilkins | 184/1.5 |
| 2008/0308351 | A1 * | 12/2008 | Godek | 184/1.5 |
| 2009/0101440 | A1 * | 4/2009 | Morgan | 184/1.5 |
| 2011/0194913 | A1 * | 8/2011 | Lewis et al. | 411/432 |
| 2011/0284539 | A1 * | 11/2011 | Stevenson | 220/233 |
| 2012/0318799 | A1 * | 12/2012 | Spix et al. | 220/304 |
| 2013/0048115 | A1 * | 2/2013 | Wise | 137/561 R |
| 2013/0068778 | A1 * | 3/2013 | Griffiths et al. | 220/601 |
| 2014/0027007 | A1 * | 1/2014 | Vargas | 141/1 |

* cited by examiner

*Primary Examiner* — William E Dondero
*Assistant Examiner* — Robert T Reese
(74) *Attorney, Agent, or Firm* — Gardner, Linn, Burkhart & Flory, LLP

(57) ABSTRACT

A universal drain plug system and method allow for the use of a single tool, such as a wrench, for installing and removing drain plugs from fluid containers such as vehicle oil pans. The system includes a plurality of different drain plugs, each with a substantially identical tool-engaging head portion, but with a different threaded shaft. The threaded shafts may differ in diameter, length, and thread dimensions including thread height and pitch, for example.

19 Claims, 1 Drawing Sheet

UNIVERSAL DRAIN PLUG SYSTEM AND METHOD

CROSS REFERENCE TO RELATED APPLICATION

The present application claims the benefit of U.S. provisional application Ser. No. 61/657,871, filed Jun. 10, 2012, which is hereby incorporated herein by reference in its entirety.

FIELD OF THE INVENTION

The present invention relates generally to drain plugs and, more particularly, to drain plugs for use on fluid containers such as oil pans and the like.

BACKGROUND OF THE INVENTION

Drain plugs are commonly used for sealing fluid drain holes, such as those found in vehicle engine oil pans and the like. Because of the large number of different vehicle manufacturers, it is common for vehicle maintenance shops to keep a supply of many different wrenches on hand, in both metric and English units, for removing and reinstalling different drain plugs. Because oil pan drain plugs are typically accessed from a pit in the floor below the vehicle, it is often necessary for the maintenance facility to keep many different sizes of wrenches within easy reach of a service technician located in the pit, which is typically dark, dirty, and cramped. However, it is generally undesirable to use adjustable wrenches (e.g., crescent wrenches), since those tend to round off the corners of the drain plug heads, rendering them unusable.

SUMMARY OF THE INVENTION

The present invention provides a universal drain plug system and method for sealing fluid drain holes, such as the drain hole of an engine oil pan or the like. The universal drain plug system allows vehicle maintenance facilities, in particular oil change facilities, to reduce the number of wrenches that are typically kept within easy reach of a maintenance technician. For example, typical "quick-lube" oil change shops must work very quickly to change the oil of each vehicle that arrives for service, in order to keep costs low and customers satisfied. To do this, a maintenance technician is typically positioned in a pit in the floor of the maintenance facility, and each customer's car is positioned over the pit so that the pit technician can remove the drain plug, drain the used motor oil (or transmission oil, gear lube, etc.) from the vehicle's oil pan, and replace the plug. Such pits are typically cramped, poorly lit, and dirty, making it difficult for a technician to quickly identify and select the proper size of wrench for removing and replacing each vehicle's drain plug, which must be accomplished before fresh oil is added to the vehicle's engine by another technician located above ground.

In one form of the present invention, a drain plug system for sealing drain holes of fluid containers includes a plurality of drain plugs, each drain plug having a different shaft portion but a common head portion. The shaft portions have different shaft diameters and/or thread heights and pitches, so that each drain plug can engage a different fluid drain hole of a different fluid container (such as oil pans for different vehicles or the like). The drain plugs' common head portions have tool-engaging portions with the same dimensions so that all of the drain plugs can be engaged and turned by the same tool.

Thus, for example, the present invention allows a vehicle maintenance shop that regularly performs oil changes to retrofit customers' vehicles with universal drain plugs having the appropriate threaded shaft for each vehicle, but with a common or universal head, so that when retrofitted vehicles return to the maintenance shop for subsequent oil changes, the technician who removes the drain plugs can do so using a single wrench on each retrofitted vehicle. In this manner, returning vehicles can all be serviced with a single wrench, which reduces the service time and clutter in each maintenance technician's work space.

These and other objects, advantages, purposes, and features of the present invention will become apparent upon review of the following specification in conjunction with the drawings.

DESCRIPTION OF THE PREFERRED EMBODIMENTS

Figure 1:
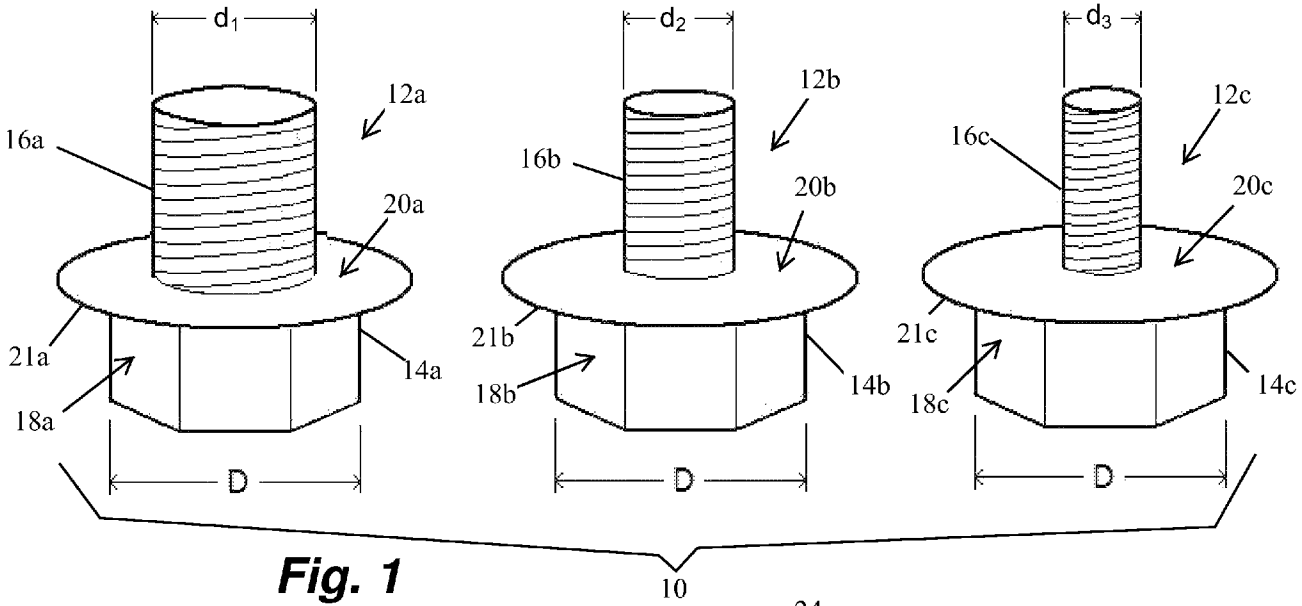
FIG. 1 is a perspective view of three different drain plugs of a universal drain plug system in accordance with the present invention.

Referring now to the drawings and the embodiments illustrated therein, a universal drain plug system 10 includes a plurality of drain plugs 12*a-c*, each having a respective head portion 14*a-c* of the same general size and shape (with substantially equal head diameters D), and respective threaded shaft portions 16*a-c* having different diameters $d_{1-3}$ and/or thread dimensions (e.g. thread height and pitch), such as shown in FIG. 1. Head portions 14*a-c* include respective tool-engaging regions 18*a-c* (such as a hexagonal-shaped portion or region that is received in or by a wrench or socket or tool for rotatably tightening or loosening the drain plug), and generally planar surfaces 20*a-c* facing the direction from which threaded shaft 16*a*-16*b* extends or projects from the head portions 14*a-c*. Optionally, a flange 21*a-c* is formed or established at each head portion 14*a-c*, and forms a portion of a sealing surface for engagement with an oil pan or the like (with the surfaces 20*a-c* at the engaging portions of the flanges 21*a-c*), as will be described below.

Figure 2:
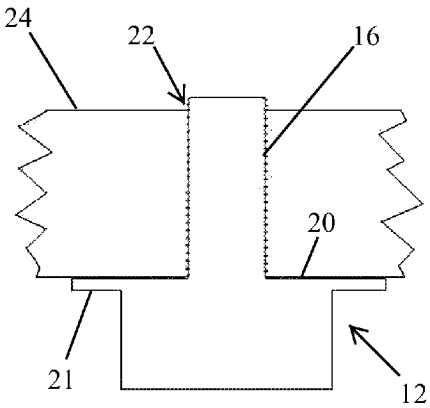
FIG. 2 is a side sectional elevation of one of the drain plugs of FIG. 1, shown threaded into a drain hole of an oil pan.

In the illustrated embodiment of FIG. 1, a first drain plug 12*a* has a thread diameter $d_1$ that is relatively large, while a second drain plug 12*b* has a thread diameter $d_2$ that is somewhat smaller than $d_1$, and a third drain plug 12*c* has a still smaller thread diameter $d_3$. In addition, each threaded shaft 16*a-c* may have different thread dimensions, such as metric and English-unit threads, so that each of the drain plugs is configured to engage a different size and/or thread configuration of the drain holes that are likely to be encountered in a given application. It will be appreciated that substantially any number of different thread diameters, heights, and pitches may be provided in a kit or system of universal drain plugs, with each drain plug having a respective head that is substantially identical to the others, to facilitate the use of a single tool to engage all of the drain plug heads. For example, a universal drain plug system or kit of the present invention may include or provide at least three drain plugs, preferably at least five drain plugs, and optionally may provide at least ten different drain plugs, with each drain plug having the same head size but different shaft diameters or thread configuration. Thus, a technician may select one drain plug 12 from the assortment of drain plugs 12*a-c* of drain plug system 10, and threadedly engage threaded shaft 16 in a drain hole 22 of an oil pan 24 (FIG. 2). Because the head size and shape is universal across all drain plugs in the universal drain plug system 10, the service technician can readily remove or re-install whichever drain plug 12 is selected from the system 10 to fit in the hole 22 of oil pan 24, using a single tool.

Thus, and as shown in FIG. 2, a selected one of the drain plugs of a universal drain plug system or kit of the present invention may be threaded into the hole 22 and tightened so that the flange 21 and generally planar surface 20 are engaged against the container or oil pan 24. Optionally, the drain plug may include an O-ring or the like around the shaft to engage and seal between the flange/surface and the oil pan when the drain plug is tightened (and the flange may include a rib such as described in U.S. Pat. No. 8,418,812, which is hereby incorporated by reference in its entirety).

Accordingly, the universal drain plug system of the present invention allows for the commonization of drain plugs, in particular for the benefit of vehicle maintenance shops that service large volumes of different vehicles. For example, when a vehicle oil pan is equipped with a non-universal drain plug, the non-universal drain plug can be removed using an appropriate wrench, and then replaced with an appropriate one of the universal drain plugs 12 taken from universal drain plug system 10. This enables the use of a single wrench for future removal and reinstallation of all universal drain plugs, regardless of the type of drain plug that was original to the vehicle. It will be appreciated that the principles of the present invention are equally applicable to substantially all fluid drain plugs typically found on a vehicle, or in other applications, including transmission oil and differential oil drains, for example.

The drain plug retrofit or replacement process typically includes determining the thread type of the original drain plug and oil pan hole. This may be accomplished, for example, by using a male thread gauge to measure the threads of the drain plug hole, using a female thread gauge to measure the threads of the original drain plug, or by using a lookup table or other information source to determine the proper thread for a particular application or vehicle. Once the correct thread is determined, the technician can select the proper drain plug from the universal drain plug system or kit according to the diameter and thread dimensions of its threaded shaft, and then insert the selected drain plug into the oil pan hole in place of the original OEM drain plug.

Optionally, different retrofit kits may be provided with drain plug head portions that generally correspond to a size that is common to vehicles that are typically serviced by a given vehicle maintenance shop. For example, a shop that specializes in European or Asian vehicles may select a metric universal drain plug kit with a common metric head size that is already frequently found on the vehicles it services, while a shop that specializes in U.S. vehicles may select an English or SAE drain plug kit with a common English or SAE head size. The ability to select a universal drain plug retrofit kit having a head size that is already common to a range of vehicles helps to minimize the frequency with which a given shop will need to replace drain plugs to achieve substantial commonality among the vehicles it services.

Therefore, the present invention provides a universal drain plug system that allows technicians or service personnel to retrofit the oil pans of various vehicles that are serviced by a maintenance shop so that the retrofitted drain plugs can then be removed and replaced with a single tool, which can save maintenance time and thus improve the efficiency for future work on the vehicle. By providing a plurality of drain plugs having substantially the same head, with multiple different threaded shafts, substantially any drain plug hole can be accommodated, without need for different tools to engage different drain plug heads.

Changes and modifications to the specifically described embodiments may be carried out without departing from the principles of the present invention, which is intended to be limited only by the scope of the appended claims, as interpreted by the principles of patent law including the doctrine of equivalents.

The embodiments of the invention in which an exclusive property is claimed are defined as follows:

1. A drain plug system for sealing fluid drain holes of fluid containers, said drain plug system comprising:

a plurality of drain plugs, each of said drain plugs having a respective threaded shaft portion and a respective head portion, said threaded shaft portions configured to be threadedly received in different respective fluid drain holes of fluid containers, and each of said head portions comprising a substantially identically-dimensioned and substantially identically-shaped tool-engaging portion whereby each of said drain plugs is configured for engaging and being rotatably driven by an identical tool having a fixed head-engaging portion; and wherein said shaft portion of a first of said drain plugs comprises a first thread dimension and said shaft portion of a second of said drain plugs comprises a second thread dimension that is different from said first thread dimension, whereby said shaft portion of said first drain plug is configured for threaded engagement with a first fluid drain hole of a first fluid container, said shaft portion of said second drain plug is configured for threaded engagement with a second fluid drain hole of a second first fluid container, and wherein said first and second thread dimensions are such that said shaft portion of said first drain plug is not threadable into the second fluid drain hole and said shaft portion of said second drain plug is not threadable into the first fluid drain hole.

2. The drain plug system of claim 1, wherein said plurality of drain plugs comprises a plurality of metric drain plugs having respective threaded shafts of different metric thread dimensions, and a plurality of English or SAE drain plugs having respective threaded shafts of different English or SAE thread dimensions.

3. The drain plug system of claim 1, wherein said system is configured for sealing oil drain holes of oil pans of vehicles.

4. The drain plug system of claim 1, wherein said plurality of drain plugs comprises a kit including at least five different drain plugs in said plurality of drain plugs, each of said at least five different drain plugs having respective tool-engaging portions of substantially the same dimensions and configuration as one another, and each of said at least five drain plugs having respective shaft portions with different thread dimensions from one another.

5. The drain plug system of claim 1, wherein said plurality of drain plugs comprise flange portions positioned between said threaded shaft portions and said tool-engaging portions of said head portions.

6. The drain plug system of claim 1, wherein each of said tool-engaging portions comprises a hexagonal surface.

7. The drain plug system of claim 6, wherein said hexagonal surfaces comprise male hexagonal surfaces.

8. A drain plug system for sealing fluid drain holes of fluid containers, said drain plug system comprising:

a first plurality of drain plugs, each of said first plurality drain plugs having a first threaded shaft portion and a first head portion, said first head portion having a first tool-engaging portion;

a second plurality of drain plugs, each of said second plurality drain plugs having a second threaded shaft portion and a second head portion, said second head portion having a second tool-engaging portion;

a third plurality of drain plugs, each of said third plurality drain plugs having a third threaded shaft portion and a third head portion, said third head portion having a third tool-engaging portion;

wherein said first, second and third threaded shaft portions of said first, second and third pluralities of drain plugs comprise first, second and third thread dimensions, respectively, whereby said first, second and third threaded shaft portions are configured to be threadedly received in three respective differently-threaded fluid drain holes of three different fluid containers; and wherein said first, second and third tool-engaging portions of said first, second and third head portions are substantially identical to one another in configuration and dimensions, whereby each drain plug of said first, second and third pluralities of drain plugs is configured for engaging an identical tool having a fixed head-engaging portion.

9. The drain plug system of claim 8, wherein (1) said first plurality of drain plugs is incompatible for threaded sealing engagement with second and third ones of the differently-threaded fluid drain holes, (2) said second plurality of drain plugs is incompatible for threaded sealing engagement with first and third ones of the differently-threaded fluid drain holes, and (3) said third plurality of drain plugs is incompatible for threaded sealing engagement with first and second ones of the differently-threaded fluid drain holes.

10. The drain plug system of claim 9, wherein at least one of said first, second and third pluralities of drain plugs comprise English or SAE threaded shaft portions, and wherein at least one other of said first, second and third pluralities of drain plugs comprise metric threaded shaft portions.

11. The drain plug system of claim 9, wherein all of said first, second and third threaded shaft portions of said first, second and third pluralities of drain plugs comprise either (1) English or SAE threaded shaft portions, or (2) metric threaded shaft portions.

12. The drain plug system of claim 9, wherein said first, second and third tool-engaging portions comprise hexagonal surfaces.

13. The drain plug system of claim 8, wherein said hexagonal surfaces comprise male hexagonal surfaces.

14. A method of retrofitting vehicle oil drain plugs, said method comprising:

selecting a first wrench for engaging a head portion of a first non-universal drain plug;

removing the first non-universal drain plug from an oil pan of a first vehicle;

determining the thread dimensions of a threaded shaft portion of the first non-universal drain plug;

selecting a first universal drain plug from a plurality of different universal drain plugs having substantially identical head portions and different threaded shaft portions, by matching the thread dimensions of the threaded shaft portion of the selected first universal drain plug with the thread dimensions of the threaded shaft portion of the first non-universal drain plug; and installing the first universal drain plug in the oil pan of the vehicle.

15. The method of claim 14, further comprising:

selecting a second wrench for engaging a second head portion of a second non-universal drain plug;

removing the second non-universal drain plug from an oil pan of a second vehicle with the second wrench;

determining the thread dimensions of a threaded shaft portion of the second non-universal drain plug;

selecting a second universal drain plug from the plurality of different universal drain plugs by matching the thread dimensions of the threaded shaft portion of the selected second universal drain plug with the thread dimensions of the threaded shaft portion of the second non-universal drain plug, wherein the thread dimensions of the threaded shaft portion of the second universal drain plug is different than the thread dimensions of the threaded shaft portion of the first universal drain plug; and installing the second universal drain plug in the oil pan of the second vehicle.

16. The method of claim 15, further comprising:

providing a third wrench that is configured to engage the respective head portions of both the first and second universal drain plugs; and removing or installing the first and second universal drain plugs from the respective oil pans of the first and second vehicles using the third wrench.

17. The method of claim 16, wherein the third wrench comprises a non-adjustable wrench.

18. The method of claim 14, wherein said determining the thread dimensions of the threaded shaft portion of the first non-universal drain plug comprises one of (i) threading a male thread gauge into a threaded drain plug hole of the oil pan, or (ii) threading the threaded shaft portion of the first non-universal drain plug into a female thread gauge.

19. The method of claim 18, further comprising:

selecting a second wrench for engaging a second head portion of a second non-universal drain plug;

removing the second non-universal drain plug from an oil pan of a second vehicle with the second wrench;

determining the thread dimensions of a threaded shaft portion of the second non-universal drain plug;

selecting a second universal drain plug from the plurality of different universal drain plugs by matching the thread dimensions of the threaded shaft portion of the selected second universal drain plug with the thread dimensions of the threaded shaft portion of the second non-universal drain plug, wherein the thread dimensions of the threaded shaft portion of the second universal drain plug is different than the thread dimensions of the threaded shaft portion of the first universal drain plug;

installing the second universal drain plug in the oil pan of the second vehicle;

providing a third wrench that is configured to engage the respective head portions of both the first and second universal drain plugs; and removing or installing the first and second universal drain plugs from the respective oil pans of the first and second vehicles using the third wrench.

* * * * *